US007071672B2

(12) United States Patent
Drusenthal

(10) Patent No.: US 7,071,672 B2
(45) Date of Patent: Jul. 4, 2006

(54) METHOD AND CIRCUIT ARRANGEMENT FOR GENERATING AN OUTPUT VOLTAGE

(75) Inventor: Ullrich Drusenthal, Heilbronn (DE)

(73) Assignee: ATMEL Germany GmbH, Heilbronn (DE)

( * ) Notice: Subject to any disclaimer, the term of this patent is extended or adjusted under 35 U.S.C. 154(b) by 0 days.

(21) Appl. No.: 10/490,794

(22) PCT Filed: Sep. 11, 2002

(86) PCT No.: PCT/EP02/10153

§ 371 (c)(1),
(2), (4) Date: Mar. 24, 2004

(87) PCT Pub. No.: WO03/029910

PCT Pub. Date: Apr. 10, 2003

(65) Prior Publication Data

US 2004/0245978 A1 Dec. 9, 2004

(30) Foreign Application Priority Data

Sep. 24, 2001 (DE) ..... 101 46 849

(51) Int. Cl.
*G05F 3/16* (2006.01)

(52) U.S. Cl. ..... 323/315; 323/314; 323/349

(58) Field of Classification Search ..... 323/304, 323/311–315, 318, 349, 350

See application file for complete search history.

(56) References Cited

U.S. PATENT DOCUMENTS

| | | | | |
|---|---|---|---|---|
| 4,352,056 | A * | 9/1982 | Cave et al. | 323/314 |
| 4,399,374 | A | 8/1983 | Boeke | |
| 5,304,861 | A | 4/1994 | Fruhauf et al. | |
| 5,440,224 | A * | 8/1995 | Kimura | 323/313 |
| 5,519,313 | A * | 5/1996 | Wong et al. | 323/315 |
| 5,570,008 | A * | 10/1996 | Goetz | 323/315 |
| 6,160,393 | A * | 12/2000 | Ahn et al. | 323/315 |

FOREIGN PATENT DOCUMENTS

| | | |
|---|---|---|
| JP | 61133423 | 6/1986 |
| JP | 09265329 | 10/1997 |

OTHER PUBLICATIONS

Tietze Schenk, 11th Edition, pp. 306, 307, 317, 319, 329, 335, 975, and 976, no date.

* cited by examiner

*Primary Examiner*—Gary L Laxton
(74) *Attorney, Agent, or Firm*—W. F. Fasse; W. G. Fasse

(57) ABSTRACT

An output voltage is generated, in that an initializable current source is transferred into a current-conducting state by an initializing signal produced by an initializing unit, and then provides current to a voltage-limiting element. The output voltage is tapped from the voltage-limiting element. Thereby, a small operating current consumption can be achieved with a large supply voltage range.

19 Claims, 2 Drawing Sheets

METHOD AND CIRCUIT ARRANGEMENT FOR GENERATING AN OUTPUT VOLTAGE

FIELD OF THE INVENTION

The present invention relates to a method and a circuit arrangement for generating an output voltage.

BACKGROUND INFORMATION

In general, electronic circuits are used for generating an output voltage, in order to generate a prescribed value of an output voltage for driving a load, for a prescribed value or value range of input voltages. However, such a circuit arrangement requires a reference voltage, which is generally generated by means of a diode structure, for example a Zener diode. The current through the diode structure is generally limited by means of a pre-resistance and is proportional to the magnitude of the input voltage. In order that the current through the diode structure is sufficiently large, with a variable input voltage, the pre-resistance must be dimensioned correspondingly small, that is to say, at higher input voltages, the current consumption of the circuit arrangement increases. Instead of using a pre-resistance, diode structures may be supplied with current by means of current sources. Various types of current sources are known for this purpose from the publication "Tietze Schenk, $11^{th}$ Edition, page 306 et seq.". It is disadvantageous, that the disclosed current sources comprise a high operating current consumption and/or a high current variation of the output current for a variable input voltage. Band gap circuits for generating reference voltages are further known from the publication "Tietze Schenk, $11^{th}$ Edition, page 975 et seq.". It is disadvantageous in that context, that the band gap circuit for generating an output voltage, especially for a high input voltage range, comprises a high current consumption, which, for example, will tend to discharge the battery in applications in a motor vehicle with a switched-off ignition. Moreover, due to the introduction of a 42 volt on-board power supply system in motor vehicles, there exists the demand to generate a reference voltage for a voltage range from 6 volts to 60 volts. Furthermore, the demand exists to reduce the operating current consumption of such circuit arrangements due to the reduced battery capacity.

SUMMARY OF THE INVENTION

It is an object of the present invention to present a method in which an output voltage is generated with a low or small operating current consumption for various different supply voltages. A further object of the invention exists in presenting a circuit arrangement for carrying out the method, which can be manufactured simply and economically.

The above objects have been achieved in a method and a circuit arrangement according to the invention as defined in the appended claims.

According to this, the essence of the invention consists in generating an output voltage by means of an initializable current source. For this, current is caused to flow through a voltage-limiting element by a current source or a current sink, which respectively comprises a control input, a current input and a current output, in that the current output of the current source or the current input of the current sink is transitioned or transferred from a first current-less condition or state into a second current conveying condition or state by means of an initializing signal applied to the control input, and thereafter the current output of the current source or the current input of the current sink causes current to flow through the voltage-limiting element, and an output voltage is tapped on the voltage-limiting element.

An advantage of the new method is that the operating current consumption of the circuit arrangement is reduced and held constant over the entire voltage range of the supply voltage, which encompasses 5 to 60 volts, for example. In this regard, the voltage-limiting element can be supplied with the minimum current necessary for generating the output voltage in a large supply voltage range. The operating current consumption of the current source or the current sink remains small and may, for example, be reduced to values of less than 100 nA. Especially with supply voltages that are generated by a battery, the discharge rate of the battery is reduced and the circuit arrangement can also be continuously operated even with a switched-off ignition, for example in order to generate reference voltages for monitoring devices. Furthermore, it is advantageous that a single circuit arrangement can be utilized for generating the reference voltage for various different voltage networks, such as 12 volts and 42 volts for example, in the field of the motor vehicle. Moreover, the transistors and therewith the circuit arrangement for generating the reference voltage require a small surface area within an integrated circuit and can be economically integrated.

In a further development of the method, current is caused to flow through the voltage-limiting element by means of a current mirror circuit, which is connected with the current output of the current source or the current input of the current sink. Due to the separation of the current flow through the voltage-limiting element from the current in the current source or current sink, thereby even voltage-limiting elements with a higher activating current can be supplied with current without enlarging the surface area for the transistors of the current source or of the current sink. Further, due to the separation of the two currents, the supply voltage can be reduced to values in the magnitude range or order of 200 to 300 mV above the output voltage of the voltage-limiting element, that is to say for applications in motor vehicles, for example a 5 volt output voltage can still be generated for monitoring devices even with a deeply discharged battery.

In a different further development of the method, the current at the current output of the current source or the current at the current input of the current sink is generated by means of two current mirror circuits that are cross-coupled relative to one another, whereby one of the current mirror circuits comprises a negative feedback for limiting the mirror current. In this regard it is advantageous to carry out the negative feedback by means of a resistor, and to implement the transistor, that lies in series with the resistor, with a higher current carrying capacity than its mirror transistor. Due to the negative feedback, upon application of the supply voltage, the current in the current source or the current sink is limited. Further, due to the cross-coupling of the two current mirrors, the current is adjusted to a prescribed level, which is determined by the size or magnitude of the resistor and the size or magnitude of the conductivity of the transistor lying in series with the resistor. Moreover, it is advantageous that output currents of less than 100 nA can be generated, due to the cross-coupling of the two current mirrors with resistor values which, for example, lie in the range of a few MOhm. Such resistors can be integrated with a small surface area in a circuit arrangement. Moreover, current can be caused to flow through voltage-limiting elements, which merely require a small activating current, directly by the current output or current input.

In a different further development of the method, the current mirror circuit is expanded to a current bank by means of an additional transistor, and current is caused to flow through the voltage-limiting element by means of the additional transistor. Due to the separate activation of the voltage-limiting element, voltage-limiting elements that require large output currents can be activated by means of an additional driver transistor, without increasing the operating current consumption of the two cross-coupled current mirrors. Due to the separation of the total current into a small portion that flows through the current source and a large portion that activates the voltage-limiting element, the current source or the current sink comprise a small operating current consumption.

In a further development of the method, the dependence of the output currents on the height or magnitude of the supply voltage in the current mirror circuits and/or in the current bank is suppressed by means of one or more cascode circuits. In this regard it is advantageous that the circuit arrangement can be carried out with bipolar or MOS transistors, which exhibit a high voltage dependence in their output characteristic.

In a different further development of the method, the initialization is carried out by means of a time-limited initializing signal. Investigations by the applicant have shown that the operating current consumption of the circuit arrangement is not increased if the time-limited initializing signal is generated by a circuit unit that only temporarily conducts current. Especially advantageously, the generation of a time-limited initializing signal can be carried out by means of a controlled switch, of which the control input is supplied with current for only a short temporary time by means of a capacitive voltage divider.

BRIEF DESCRIPTION OF THE DRAWINGS

In the following, the method and circuit arrangement according to the invention shall be explained on the basis of several schematic example embodiments in connection with the drawings, wherein.

DETAILED DESCRIPTION OF PREFERRED EXAMPLE EMBODIMENTS OF THE INVENTION

Figure 1:
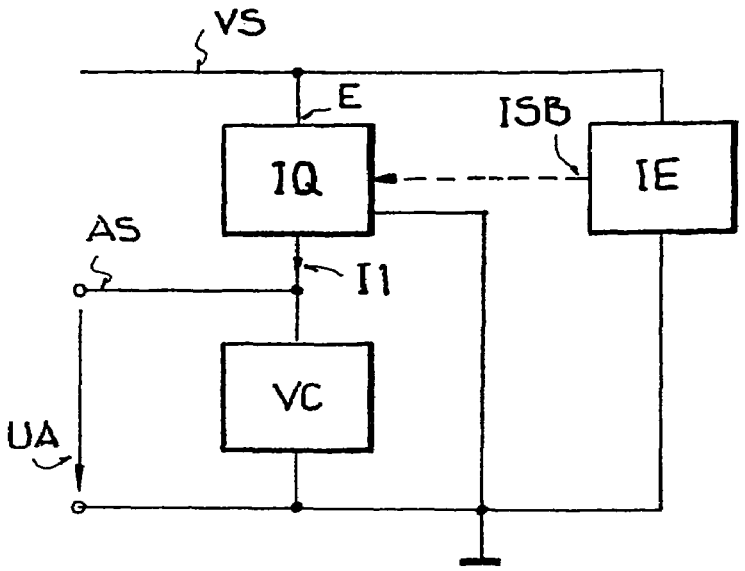
FIG. 1 shows a voltage-limiting element that is provided with current by means of a current source.

In the block circuit diagram depicted in FIG. 1, a voltage-limiting element VC is provided with current, in order to generate a stabilized output voltage UA at the output AS of the element VC. Such an output voltage UA may, for example, be utilized as a reference voltage or for driving load elements. For this, the voltage-limiting element VC is circuit-connected in series by means of a current source IQ connected with a supply voltage VS and a reference voltage preferably a ground potential. Further, the current source IQ comprises a current input E, a current output A, and an initializing input, which is connected with an initializing output ISB of an initializing unit IE. Moreover, the initializing unit IE is connected with the supply voltage VS and with the reference potential.

In the following, the functional operation of the block circuit diagram will be explained. After switching-on the supply voltage VS, a time-limited initializing signal, for example a short voltage pulse, is generated by the initializing unit IE, by means of which initializing signal the current source IQ is initialized at the initializing input. In this context, the current source IQ is transferred or transitioned from a non-current-conducting to a current-conducting state or condition. Thereafter, the current source IQ provides the current I1 through the current output A to the voltage-limiting element VC, by which the output voltage UA is generated at the output AS.

Figure 2:
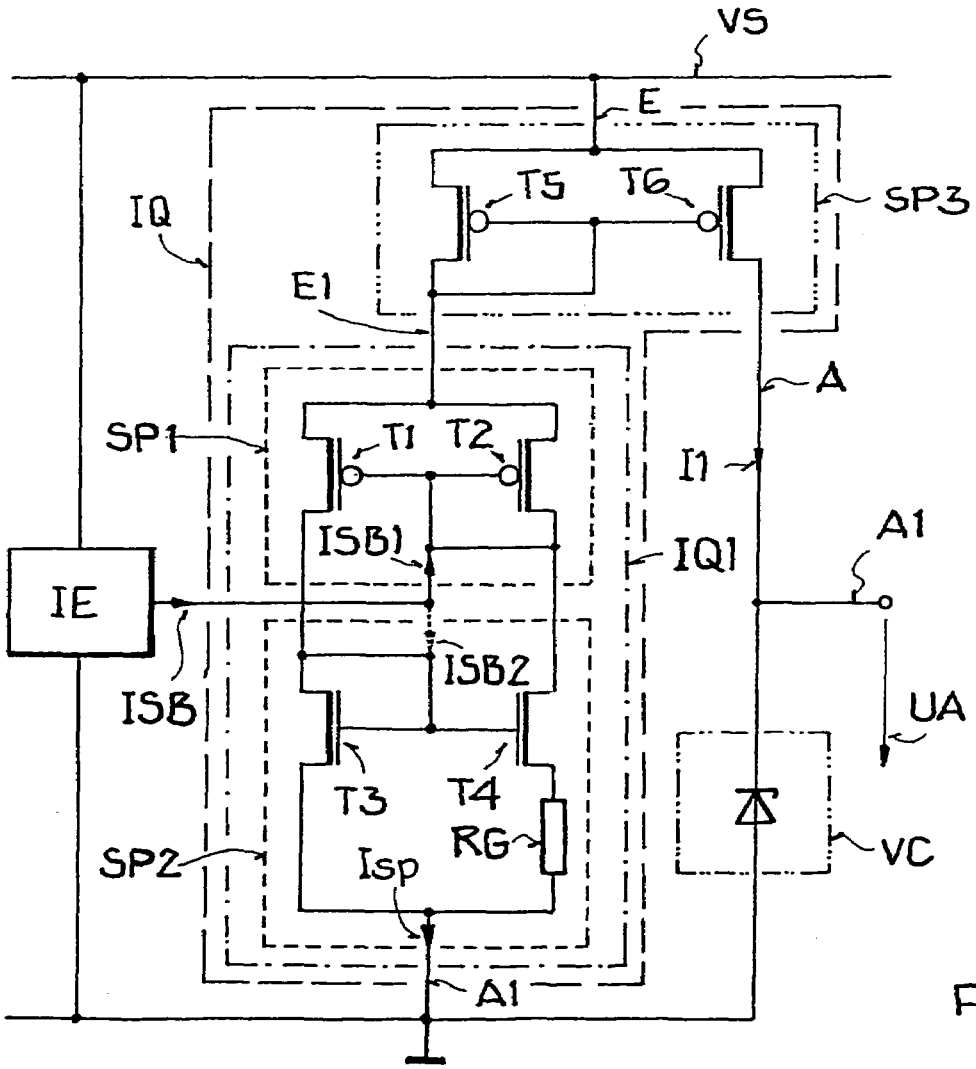
FIG. 2 shows a provision of current to the voltage-limiting element by means of a current mirror.

In the circuit arrangement illustrated in FIG. 2, the output voltage UA is generated in that the voltage-limiting element VC is provided with current by a current sink IQ1 by means of a current mirror SP3, whereby the current sink IQ1 in connection with the current mirror SP3 is identical to the current source IQ of FIG. 1. In the following, the circuit arrangement will be explained in further detail.

The current mirror SP3 comprises a PMOS transistor T5 connected in a diode circuit, that is to say the drain and the gate terminal of the transistor T5 are connected with one another. Further, the drain terminal of the transistor T5 is circuit-connected with an input E1 of the current sink IQ1. Moreover, the source terminal of the transistor T5 is connected with the supply voltage VS and with the source terminal of a PMOS transistor T6, and form the input E of the current source IQ. Further, the two gate terminals of the transistors T5 and T6 are circuit-connected with one another, while the drain terminal of the transistor T6, which forms the current output A of the current source IQ, is connected with the voltage-limiting element VC and the output AS for the output voltage UA. Furthermore, the voltage-limiting element VC is connected with the ground potential.

The current sink IQ1 comprises a first current mirror SP1, which comprises a first PMOS transistor T1 and a second PMOS transistor T2 connected in a diode circuit, whereby the source terminals of the two transistors T1 and T2 are connected with the input E1 of the current sink IQ1. Furthermore, the two gate terminals of the transistors T1 and T2 are circuit-connected with a first initializing input ISB1, whereby the initializing input ISB1 is circuit-connected with the initializing output ISB of the initializing unit IE. Further, the current sink IQ1 comprises a second current mirror SP2, which comprises a first NMOS transistor T3 connected in a diode circuit and a second NMOS transistor T4. The source terminal of the transistor T4 is connected with the output A1 of the current sink IQ1 and the source terminal of the transistor T3 by means of a negative feedback resistor RG that is circuit-connected in series. Furthermore, the two gate terminals of the transistors T3 and T4 are circuit-connected with a second initializing input ISB2. Further, the drain terminal of the transistor T1 is connected with the drain terminal of the transistor T3, and the drain terminal of the transistor T2 is connected with the drain terminal of the transistor T4.

In the following, the functional operation of the circuit arrangement will be explained. Within the current sink IQ1, the current mirror SP1 is connected with the current mirror SP2 in a cross-coupling, whereby the current mirror SP2 is embodied as a so-called "Widlar" current mirror through the negative feedback resistor RG. A cross-coupling of two current mirrors generally comprises a first current-less and a second current-conducting state or condition, whereby the second state is reliably first reached or achieved by means of an initializing signal. In this context, the initializing signal is generated by the initializing unit IE upon application of the supply voltage VS, and is applied to the input ISB1, whereby the initializing signal may be applied to the input ISB2 as an alternative to the input ISB1. In the second state, a current Isp is drawn or pulled by the current sink IQ1 from the current mirror SP3, thereafter the voltage-limiting element VC, which is embodied as a Zener diode for example, is provided with a current I1 by means of the mirror transistor T6, and the output voltage UA is generated by the element VC at the output AS. Due to the provision of current for the voltage-limiting element VC by means of the current mirror SP3, the height or magnitude of the current I1 can be adapted to the electrical parameters of the voltage-limiting element VC, without increasing the current Isp in the current sink IQ1. Within the current sink IQ1, the transistors T3 to T4 are preferably operated in the respective subthreshold region. Further, it is advantageous to equip the transistor T4 with a higher conductivity in comparison to the transistor T3, so that the difference of the control voltage of the two transistors drops off over the negative feedback resistor RG. Hereby, the output current of the mirror SP2 is determined, which controls the current mirror SP1 via the cross-coupling, whereby the current mirror SP1 in turn controls the current mirror SP2. The current Isp in the two current mirrors SP1 and SP2 can be described with the following equation:

$$Isp=2*(Ut*ln(L4/L3))/RG$$

with Ut for the thermal energy voltage which amounts to approximately 25 mV, L3 or L4 the conductance or conductivity value of the transistor T3 or T4, and RG for the negative feedback resistance. Due to the cross-coupling in connection with the negative feedback, the current Isp may be generated, for example, in the range of 100 nA with resistance values of RG lying in the range of 1 MOhm. With current sources that use reference voltages other than the thermal energy voltage Ut, for example the threshold voltage of MOS transistors, resistances that are larger by up to two orders of magnitude are necessary for currents in the above mentioned order of magnitude of 100 nA. These extremely high resistance values cause high costs due to the large required chip surface areas.

Figure 3:
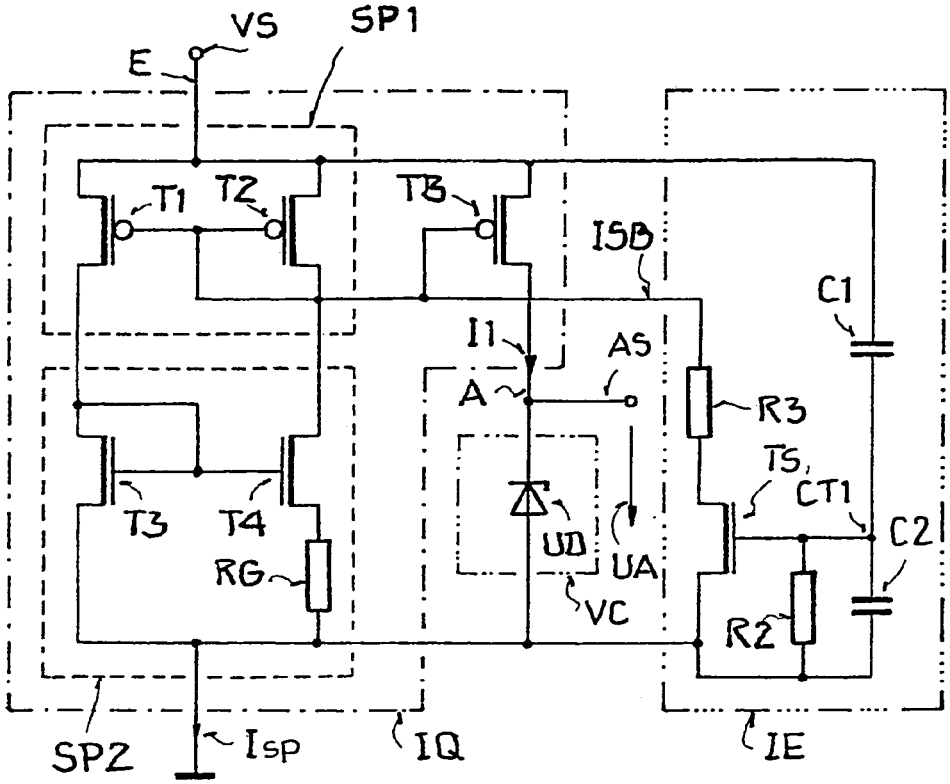
FIG. 3 shows a provision of current to the voltage-limiting element by means of two cross-coupled current mirrors, that are initialized by an initializing unit by means of a switch.

In the circuit arrangement depicted in FIG. 3, the output voltage UA is generated by means of the current source IQ, in that the current mirror SP1 is expanded to a current bank by means of a transistor TB. Thereby, the current mirror SP3 in the circuit arrangement of FIG. 2 is omitted. Further, a short-duration initializing signal is generated by initializing unit IE at the output ISB by means of a capacitive voltage divider. In the following, the circuit arrangement will be explained, whereby the construction and the functional operation of the two cross-coupled current mirrors SP1 and SP2 within the current source IQ is identical to the embodiment explained in connection with the drawings of FIG. 2.

As a further development of the example embodiment of FIG. 2, the current mirror SP1 of the current source IQ is expanded to a current bank by means of the PMOS bank transistor TB, in that the source of the transistor TB is circuit-connected with the supply voltage VS and the gate of the transistor TB is circuit-connected with the two gates of the transistors T1 and T2. Further, the drain terminal of the transistor TB is connected with the current output A of the current source IQ and with the output AS of the voltage-limiting element VC.

The initializing unit IE comprises a capacitive voltage divider with a divider point or node CT1. The voltage divider is formed of a first capacitor C1 that is connected with the supply voltage VS and with the divider node CT1, and a second capacitor C2 that is connected with the reference potential. Further, the divider node CT1 is connected with a resistor R2 that is circuit-connected to the reference potential, and with the gate of a switching transistor TS. The source terminal of the transistor TS is circuit-connected with the reference potential, the drain terminal of the transistor TS is circuit-connected in series with a resistor R3 to the output ISB of the initializing unit IE.

In the following, the functional operation of the circuit arrangement will be explained. Upon switching-on the supply voltage VS, the potential of the divider node CT1 is raised. Insofar as the potential of the divider node CT1 exceeds the threshold voltage of the transistor TS, the transistor TS becomes conductive, and the output ISB is lowered or reduced via the resistor R3 by the diode voltage of T2 relative to the value of the supply voltage. Thereby, the two cross-coupled current mirrors SP1 and SP2 are transferred or transitioned into a stable current-conducting state. In the current-conducting state, the gate of the transistor TB is activated, whereby the activating current I1 for the voltage-limiting element VC is determined by the gate potential in connection with the dimensioning of the transistor TB. If, after a time Z1, the voltage on the divider node CT1 drops below the threshold voltage of the transistor TS, due to the resistor R2 and due to the leakage currents of the capacitors C1 and C2, the transistor TS is blocked or switched off and the initializing unit IE is current-less. Since the current source IQ remains in the current-conducting state after the switching-off of the initializing unit IE, the element VC will be continuously provided with current, that is to say the stabilized output voltage UA prevails at the output of the element VC, until switching-off the supply voltage VS.

An advantage of the circuit arrangement is that the cross-coupled current mirrors SP1 and SP2 can be driven with small currents in the range of 100 nA and even smaller, substantially independent of the height or magnitude of the applied supply voltage. Especially in an application in the field of motor vehicles, a stabilized output voltage can be generated for various different battery voltages, which only slightly loads the battery even with a switched-off ignition. Moreover, the acceptable or permissible supply voltage range is determined essentially by the dielectric strength of the transistors.

Due to the low number of transistors and resistors, the circuit arrangement can be easily and economically integrated, whereby all of the transistors, except the transistor TB, comprise a small surface area. Furthermore, the current consumption of the circuit arrangement is not increased by the initializing circuit IE, since this circuit becomes current-less after the time Z1. Hereby, a very small operating current consumption is brought about for a great variability of the supply voltage VS.

Figure 4:
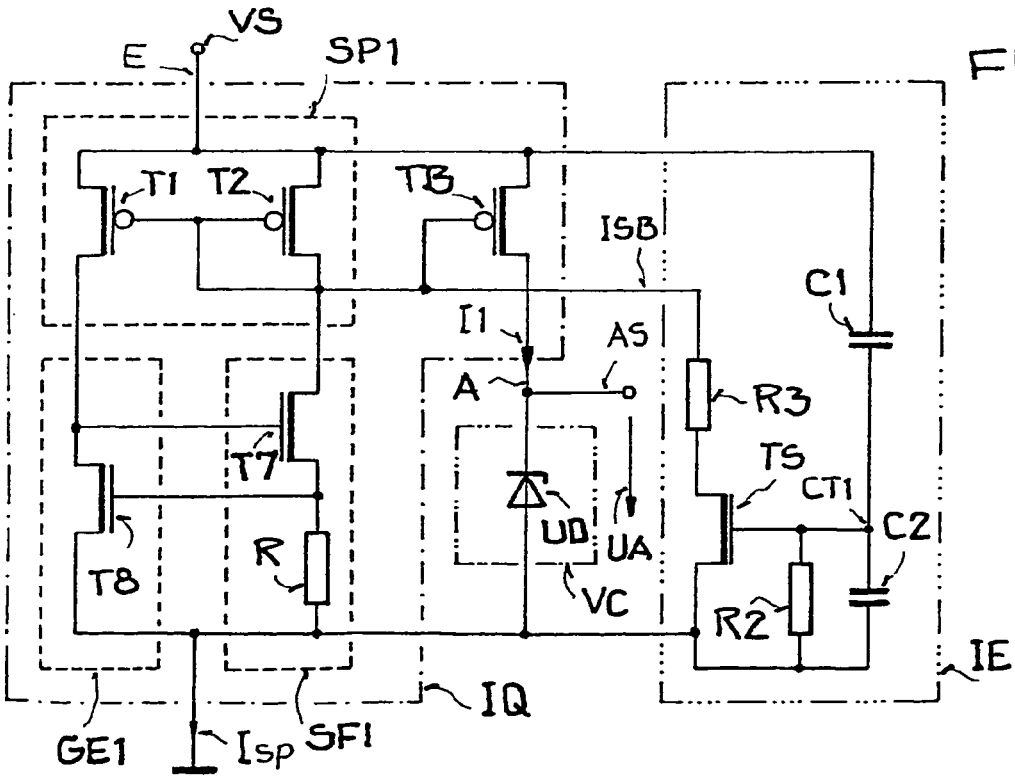
FIG. 4 shows a further embodiment of a current source for providing current to a voltage-limiting element.

In the circuit arrangement depicted in FIG. 4, the output voltage UA is generated by means of the current source IQ, in that, in distinction to the example embodiment illustrated in FIG. 3, the current mirror SP2 is replaced by a source follower SF1 with a negative feedback element GE1. In the following, the circuit arrangement will be explained by building on the disclosures in connection with the drawings of the FIG. 3.

The drain of the transistor T2 is circuit-connected with the drain of a transistor T7. Further, the source of the transistor T7 is circuit-connected with the gate of a transistor T8 and with a resistor R connected with the ground potential. Further, the drain of the transistor T1 is connected with the gate of the transistor T7 and with the drain of the transistor T8. Moreover, the source of the transistor T8 is circuit-connected with the reference potential. In the following, the functional operation of the circuit arrangement will be explained. After the current mirror SP1 becomes conductive by means of an initializing signal, as a result the transistor T7 becomes conductive and, due to the voltage drop on the resistor R, the gate potential of the transistor T7 and therewith the current Isp in connection with the current mirror SP1 is determined by means of the transistor T8. Through the transistor TB, the voltage-limiting element VC is supplied with the current I1 and the output voltage UA is generated. Even after switching-off the initializing signal, the current source IQ remains in the current conducting state until switching-off the supply voltage VS.

A further advantage of the disclosed circuit arrangements is that both bipolar as well as MOS transistors can be utilized as the transistors. Further, the current mirrors can be expanded to current banks through additional transistors, and thereby can generate further current outputs or further stabilized output voltages.

The invention claimed is:

1. Method for generating an output voltage (UA), with at least one current source (IQ) or at least one current sink, which respectively comprise a control input (ISB1), a current input (E) and a current output (A), and a voltage-limiting element (VC), characterized in that by means of an initializing signal applied to the control input (ISB1), the current output (A) of the current source (IQ) or the current input of the current sink is transferred from a first current-less state into a second current-conducting state, and in the second state, the voltage-limiting element (VC) is provided with a current (I1) by means of the current output (A) of the current source (IQ) or by means of the current input of the current sink, and an output voltage (UA) is tapped at an output (AS) of the voltage-limiting element (VC).

2. Method according to claim 1, characterized in that the voltage-limiting element (VC) is provided with current by means of a current mirror circuit (SP3), which is connected with the current output of the current source (IQ) or the current input of the current sink.

3. Method according to claim 2, characterized in that the current source or current sink further includes a bank transistor which is connected to the first current mirror circuit (SP1) to form a current bank, and by which the voltage-limiting element (VC) is provided with current.

4. Method according to claim 2, further comprising applying a supply voltage (VS) to a supply input of the current source or the current sink, and through a cascode circuit suppressing a dependence of the current (I1) at the current output of the current source (IQ) on a value of the supply voltage (VS).

5. Method according to claim 1, characterized in that, for supplying current to the voltage-limiting element (VC), the current (I1) at the current output (A) of the current source (IQ) or the current at the current input of the current sink is generated by means of first and second current mirror circuits (SP1, SP2) that are cross-coupled relative to one another, whereby the second current mirror circuit (SP2) comprises a negative feedback for limiting a mirror current (Isp).

6. Method according to claim 5, characterized in that the negative feedback is carried out by means of a negative feedback resistor (RG) lying in an output path of the second current mirror circuit (SP2), and wherein a transistor (T4) lying in an output path of the second current mirror circuit (SP2) comprises a higher current carrying capacity than another transistor (T3) lying in an input path of the second current mirror circuit (SP2).

7. Method according to claim 6, characterized in that the current source or current sink further includes a bank transistor which is connected to the first current mirror circuit (SP1) to form a current bank, and by which the voltage-limiting element (VC) is provided with current.

8. Method according to claim 6, further comprising applying a supply voltage (VS) to a supply input of the current source or the current sink, and through a cascode circuit suppressing a dependence of the current (I1) at the current output of the current source (IQ) on a value of the supply voltage (VS).

9. Method according to claim 1, characterized in that the initializing signal is applied in a time-limited manner.

10. Method according to claim 9, characterized in that the initializing signal is generated by an initializing unit (IE) that is only intermittently current-conducting.

11. Method according to claim 10, characterized in that for generating the initializing signal in the initializing unit (IE), a control input of a switch (TS) is activated by means of a capacitive voltage divider.

12. Circuit arrangement for carrying out the method according to claim 1, with a current source (IQ) or a current sink, whereby a current output (A) of the current source (IQ) or a current input of the current sink is connected with a voltage-limiting element (VC), and the voltage-limiting element (VC) comprises an output (AS), characterized in that the current source (IQ) or the current sink comprises at least one control input (ISB1) for initialization, the control input (ISB1) is circuit-connected with an initializing signal output (ISB) of an initializing unit (IE), and the current source or the current sink is adapted to transition the current output or the current input thereof from a first current-less state into a second current-conducting state upon application of an initializing signal from the initializing signal output to the control input.

13. Circuit arrangement according to claim 12, characterized in that the current source (IQ) or the current sink comprises first and a second current mirrors (SP1, SP2) which are cross-coupled with one another, whereby the first or the second current mirror (SP1, SP2) is negative feedback coupled by means of a resistor (RG) circuit-connected to a reference potential, and the first or the second current mirror (SP1, SP2) is circuit-connected with the control input of a transistor (TB) to form a current bank, and the transistor (TB) is connected with the input of the voltage-limiting element (VC).

14. Circuit arrangement according to claim 12, characterized in that the initializing unit (IE) comprises at least one capacitive voltage divider, of which a divider node (CT1) is connected with a control input of a switch (TS), and an output of the switch (TS) forms the initializing signal output (ISB) of the initializing unit (IE).

15. Circuit arrangement according to claim 14, characterized in that, for time limiting the initializing signal, the divider node (CT1) comprises a component (R2) connected with a reference potential.

16. Method according to claim 1, further comprising applying a supply voltage to a supply terminal of the current source or the current sink before applying the initializing signal to the control input, and keeping the current output of the current source or the current input of the current sink in the first current-less state after the supply voltage is applied and until the initializing signal is applied.

17. A method of generating an output voltage using a circuit including a voltage-limiting element and a current driver arrangement selected from the group consisting of current sources and current sinks, wherein the method comprises the steps:

a) applying a supply voltage to a supply terminal of said current driver arrangement;

b) applying an initializing signal to an initializing control input of said current driver arrangement;

c) after said step a) and before said step b), keeping said current driver arrangement in a current-less state in which said current driver arrangement does not produce a current;

d) only after and in response to said step b), transferring said current driver arrangement from said current-less state into a current-conducting state in which said current driver arrangement produces a current;

e) flowing said current produced by said current driver arrangement through said voltage-limiting element; and f) during said step e), tapping said output voltage from a voltage output of said voltage-limiting element.

18. The method according to claim 17, wherein said initializing signal is a time-limited signal that is applied to said initializing control input in said step b) during only a limited time and then ends, said applying of said supply voltage to said supply terminal continues after said limited time, and said current driver arrangement remains in said current-conducting state and continues to produce said current after said limited time.

19. The method according to claim 18, further comprising discontinuing said applying of said supply voltage and in response thereto discontinuing said current-conducting state so that said current driver arrangement stops producing said current.

* * * * *